US006152416A

United States Patent [19]

Jacob

[11] Patent Number: 6,152,416

[45] Date of Patent: Nov. 28, 2000

[54] SUPPORT HANGER FOR SUSPENDING AN OBJECT DIRECTLY BELOW A HORIZONTAL SURFACE

[76] Inventor: Daniel Jacob, 48370 Sawleaf St., Fremont, Calif. 94539

[21] Appl. No.: 09/257,067

[22] Filed: Feb. 25, 1999

Related U.S. Application Data

[63] Continuation of application No. 08/773,874, Dec. 27, 1996, abandoned.

[51] Int. Cl.[7] ..... A47B 5/04

[52] U.S. Cl. ..... 248/441.1; 248/214; 248/914

[58] Field of Search ..... 248/441.1, 465.1, 248/451, 456, 215, 214, 300, 301, 205.2, 206.3, 206.2, 914, 444.1; 281/42

[56] References Cited

U.S. PATENT DOCUMENTS

| | | | |
|---|---|---|---|
| 2,532,255 | 11/1950 | Davis | 248/215 |
| 2,565,719 | 8/1951 | Church | 248/215 |
| 3,240,463 | 3/1966 | Cook | 248/215 X |
| 3,321,166 | 5/1967 | Gordon | 248/914 X |
| 3,630,475 | 12/1971 | Barry | 248/215 |
| 4,369,948 | 1/1983 | Krauss et al. | 248/444.1 |

*Primary Examiner*—Ramon O. Ramirez
*Attorney, Agent, or Firm*—Palmer C. DeMeo

[57] ABSTRACT

A support hanger for suspending a book from a freezer door of a combination refrigerator/freezer is described. The support hanger is a continuous piece of plastic stock providing both a canted cradle to hold a book and a horizontal ledge to engage the top of the freezer door. The underneath surface of the ledge is provided with a strip of material having a plurality of either hooks or loops to engage a complementary strip of material provided on the door edge. The support hanger does not include the typical lip for engaging an opposite surface of a door or the like but rather relies on the strips of material to resist the horizontal movement of the ledge which otherwise would occur because of the weight of a suspended book.

5 Claims, 5 Drawing Sheets

SUPPORT HANGER FOR SUSPENDING AN OBJECT DIRECTLY BELOW A HORIZONTAL SURFACE

CROSS-REFERENCE TO RELATED APPLICATION

This patent application is a continuation of patent application Ser. No. 08/773,874 filed Dec. 27, 1996 naming the above inventor and entitled HANGING BOOK SUPPORT FOR KITCHEN FREEZER DOOR, now abandoned.

DISCLOSURE

Background of the Invention

The present invention relates to support hangers and, more particularly, to a versatile support hanger for suspending a weight quite stably in situations in which a hook cannot be used and it is impractical or impossible to violate the space beneath the hanger. An example is suspending an open cookbook from the top doors of refrigerators or refrigerator/freezer combinations of different styles.

Many support hangers have been developed in the past for suspending a weight from a horizontal surface. In generally, such hangers fall into two types: In one type (probably the most common) the hanger includes a hook designed to engage or otherwise interact with an object from which the support hanger is suspended to counteract the tendency of the weight to disengage itself from the relatively stationary object to which the support is fixed. Some of this type are especially designed to interact with particular objects, and thus have a hook shape specifically designed for engagement of an object of a design with which it is to interact. U.S. Pat. No. 4,711,419 (Polosky) discloses an example of this type. Other hook types include a depending lip or the like to engage and butt against a portion of the object to secure the weight to be suspended relatively stably. Examples of this type include U.S. Pat. No. 5,413,297 (Adams), U.S. Pat. No. 3,986,649 (Helmstra) and U.S. Pat. No. 2,707,610 (Fillion et al. The difficulty with this type of hook device is that there are many objects from which it is desired to suspend a weight that do not have a ledge or other surface which can interact with the abutment.

The other general type of hanger is referred to herein as the "pendulum" type. This type relies on the weight which is to be suspended to be directly below the point of engagement between the hanger and the object from which it is to be suspended in order to enable the hanger to have a relatively simple engagement portion with the object from which the weight is to be suspended. A good example of this type can be found in U.S. Pat. No. 2,064,133 (von Schroeder). As will be seen, in von Schroeder the weight is a handbag and the hanger is designed to hold such handbag directly below the plate which engages the object from which the handbag is supported.

SUMMARY OF THE INVENTION

The present invention is a support hanger for suspending a weight which has the simplicity of the hangers, such as the von Schroeder hanger, that do not rely on a hook or other means to engage the object to counteract a dislodging moment due to the weight and yet does not require that the weight to be supported be directly below the support point. It is based on the recognition that it is not necessary in such a hanger to resist the full weight of the supported material, i.e., as will be described in more detail below it is only necessary that the turning moment provided by the weight tending to remove the weight from the supporting object surface be resisted. The result is a very simple support hanger arrangement which can be used to suspend a relatively considerable weight, such as that provided by a cookbook, from a refrigerator or freezer door without having to have a lip engage the object on the opposite side of the weight to be supported.

From the broad standpoint, the invention includes the combination of support means for supporting the weight and a generally horizontal ledge for engaging a surface on the object from which the weight (and the hanger) is to be suspended. Rather than the typical lip or other abutment found on this general type of support hanger, it includes as part of the combination resistance means on the ledge positioned to cooperate with the surface to resist any force that might result in generally horizontal movement of the ledge while the weight is supported.

Most desirably, a continuous piece of plastic provides both the support means and the generally horizontal ledge. This continuous piece of plastic is configured so that all of the support means structure is outside the vertical volume directly below the ledge defined by a projection of the ledge downward. The result is that the hanger is useful to suspend a book or other weight from an object which is configured such that the volume below the horizontal ledge is inaccessible.

Other features and advantages of the invention either will become apparent or will be described in connection with the following, more detailed description of the invention and variations.

BRIEF DESCRIPTION OF THE DRAWINGS

With to the accompanying sheets of drawings.

DETAILED DESCRIPTION OF THE PREFERRED EMBODIMENTS

Figure 1:
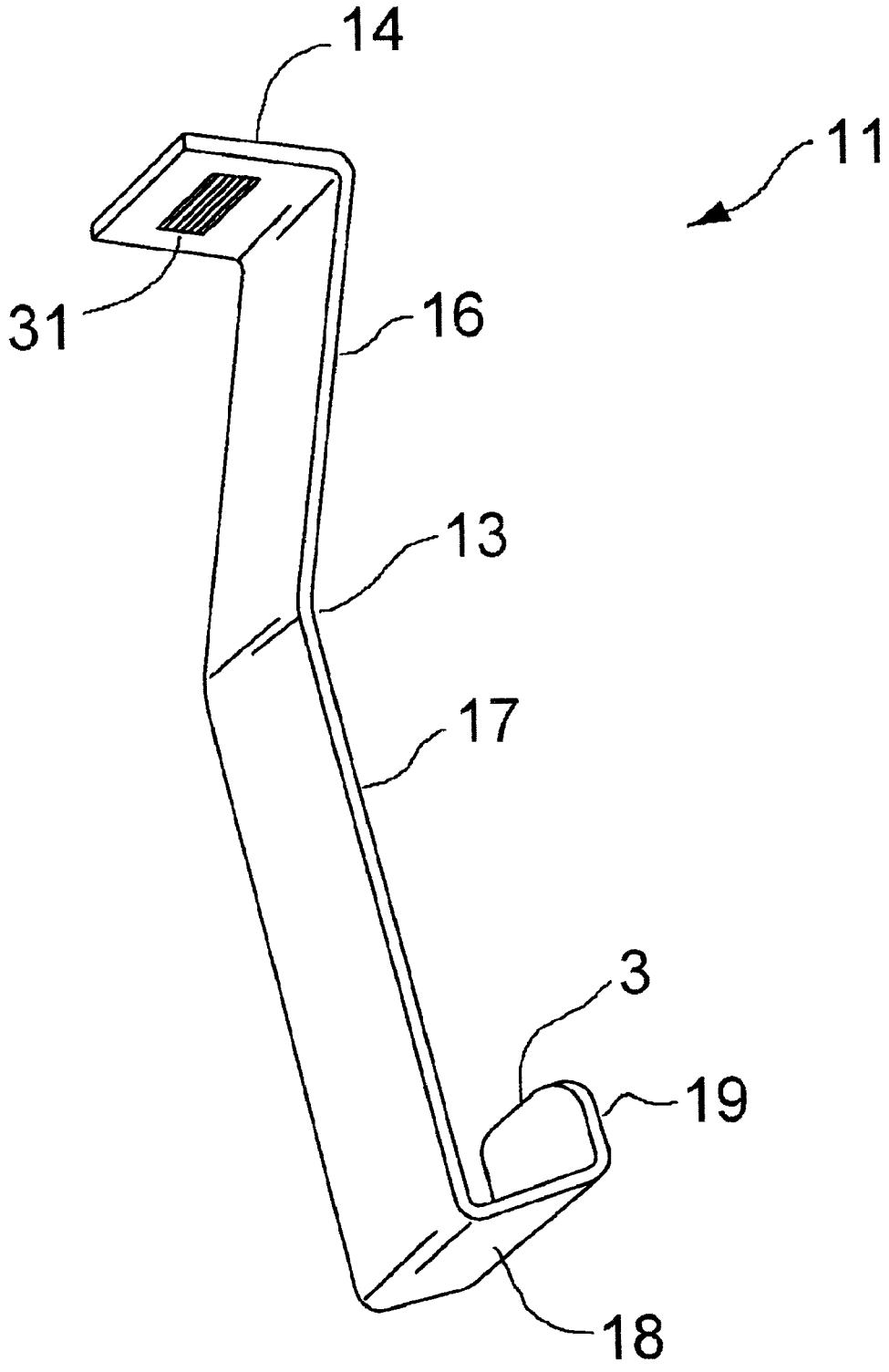
FIG. 1 is an overall isometric view of a preferred embodiment of the invention.

The following, relatively detailed description is provided to satisfy the patent statutes. It will be appreciated by those skilled in the art, though, that various changes and modifications can be made without departing from the invention.

A preferred embodiment of the support hanger of the invention is generally referred to by the reference numeral 11. Most of such support hanger is made from a continuous piece of transparent plastic stock. This sheet stock is cut to have an outline to define, when it is bent, the shape of the final support hanger.

Figure 3:
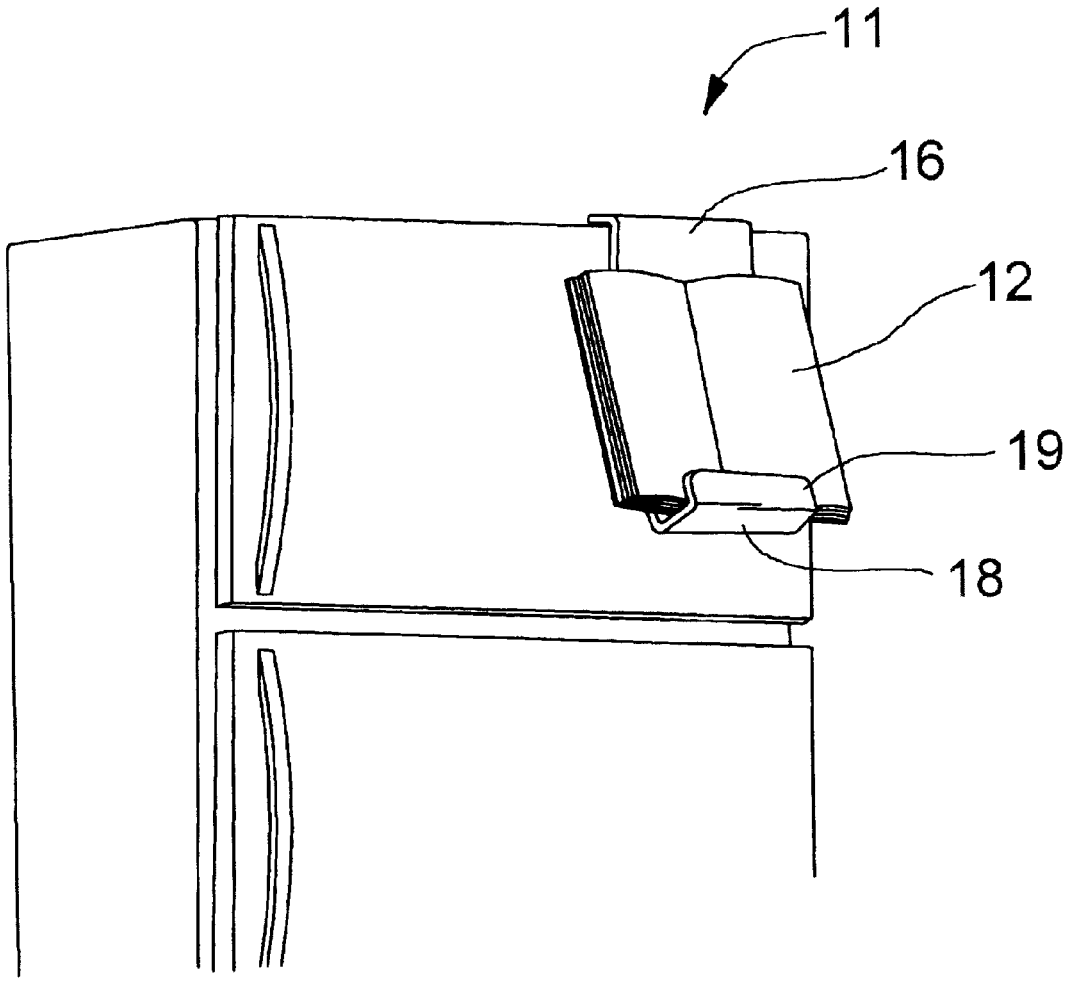
FIG. 3 is an isometric partial view showing the preferred embodiment of the invention of FIG. 1 suspending a cookbook from a freezer door.

The support hanger 11 includes means for supporting a weight, such as a book 12 (FIG. 3). To this end it is bent as at 13 with a slight obtuse angle to cant from a suspending portion defined by a ledge 14 and a downwardly projecting plate section 16. The angled projecting plate section 17 formed because of the bend 13 cooperates with an end section 18 which is generally perpendicular thereto and a lip 19, to define a cradle for a weight. In this particular case the cradle is especially designed to suspend an open book at a particular page. Such an arrangement is illustrated in FIG. 3 in which the support hanger of the invention is used to suspend a book, such as a cookbook, from a top freezer door of a combination upright refrigerator/freezer. Although all aspects of the support hanger described to this point are transparent in this preferred embodiment, it is only really necessary that those portions which might block print, i.e., lip 19 in this implementation, be so transparent.

In general, it is because of the angular relationship between the plate sections 16 and 17 that the cant is provided for suspending books. In this connection, it must be remembered that the top edge of most books will bear against the section 16 and the cant or slant provided on the book typically will not be parallel to the plate section 17. The invention is not limited to any particular height but as a practical matter the plate 16 should extend about two inches above the height of a typical book to be suspended. It is preferable that the width be about seven inches since this width will hold both a small pocket book and a large cookbook.

The support hanger of the invention is typical of most suspension-type hangers in that it includes a generally horizontal ledge 21 for engaging a generally horizontal surface 22 of an object (in this case, a freezer door) 23 from which the weight is to be suspended. While it has been recognized that it is desirable to be able to cant a book or the like from an object, such as a freezer door, which might prevent the book from being within the vertical volume below the supporting ledge, most have felt that it was necessary to include a lip on the end of the ledge to abut an opposed side of the object. In keeping with the invention, however, the ledge 21 is not part of a hook having a lip or other obstruction piece for abutting a surface of the object opposite the surface from which the weight is to be suspended. Rather it includes a resistance means to cooperate with the object surface to resist any force that might result in generally horizontal movement of the ledge relative to the surface. That is, while the traditional view is that a support hanger of this nature must directly resist the pull of gravity on the weight to be supported, the inventor recognized that it is only necessary to resist the turning moment provided by the weight. This turning moment is represented by the product of vector 24 and distance 25. The opposing moment, equal to the turning moment, is represented by the product of vector 26 and distance 35. Since distance 35 is several times larger than distance 25, vector 26, the force attempting to dislodge the hanger is, in the same proportion, several times smaller than the weight of the book, vector 24.

Substituting practical numbers for the above analysis, distance 35 is about 9 inches, and distance 25 about 2 inches. Therefore a book weighing 4 pounds produces a dislodging force on supporting members 21 of 2/9 of 4 pound, i.e., about 0.9 pounds. The latter force is easily overcome by a strip of hook and loop fasteners ¾ inches wide and 5 inches long, represented by the reference numerals 31 and 32. Strip 31 is adhered to the underneath surface of the ledge 21 and cooperates with the complementary strip 32 of hooks or loops adhered to the surface 22.

In the preferred embodiment the resistance means to inhibit horizontal movement is simply a strip of material as mentioned above. A strip of material 31 of the type commonly referred to by the trademark "Velcro" having a plurality of hooks or loops is adhered to the underneath surface of the ledge 21 and cooperates with a complementary Velcro strip 32 of hooks or loops adhered to the surface 22. When one wants to install the hanger on an object, one simply mates these strips of Velcro and provides a slight downward force.

Most designers of suspension-type support hangers would, it is believed, start out with the assumption that it was necessary to resist the weight of the object and that something as simple as "Velcro" could not obviate the necessity of providing a lip or the like on the ledge to engage the object.

Figure 2:
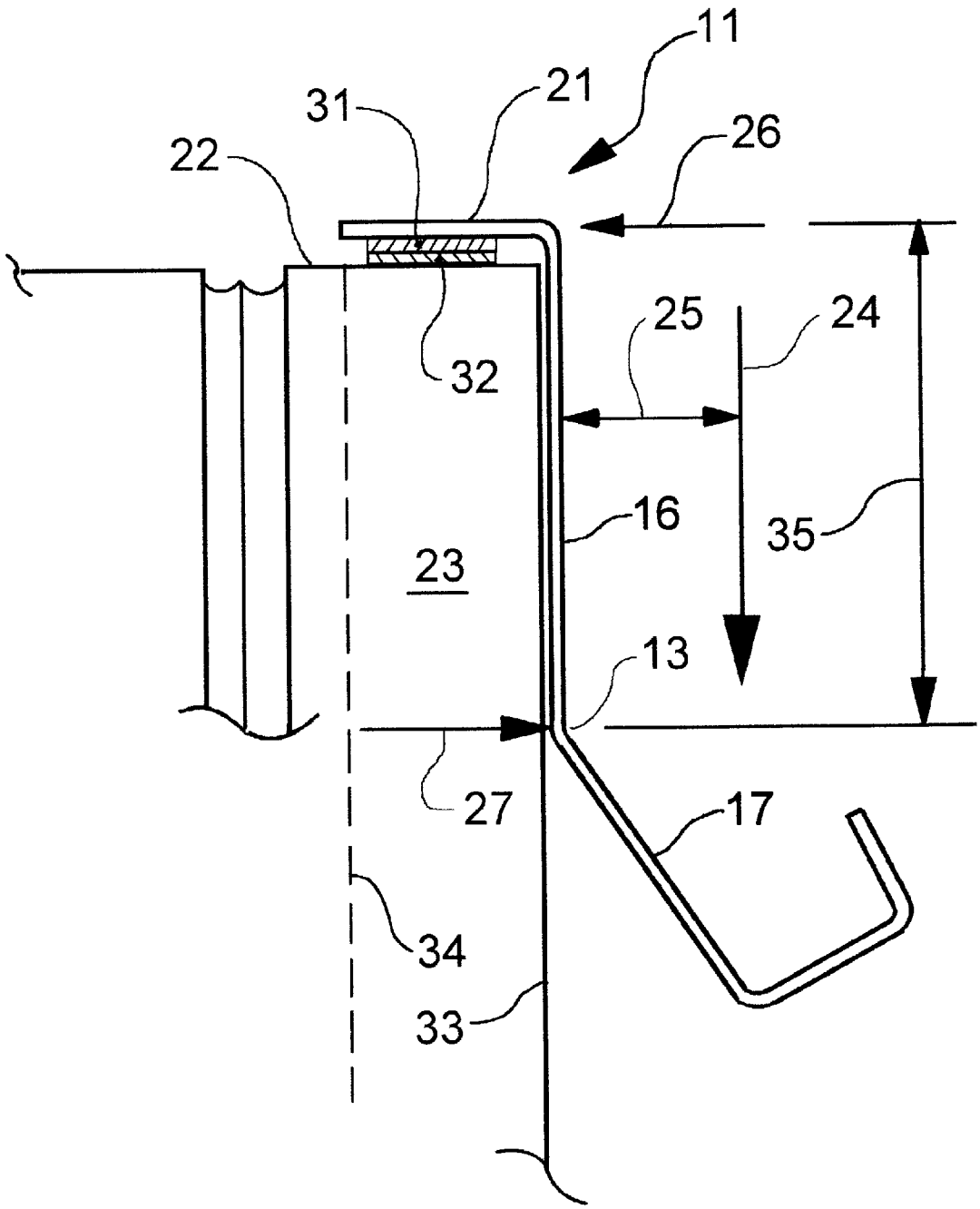
FIG. 2 is a sectional view of the preferred embodiment in combination with certain force vectors.

It should be noted that use of the invention does not require any of the hanger support means to be within the vertical volume below the ledge 21 defined by the projection of the ledge. This vertical volume is defined of course by the vertical edge 33 of the object from which the weight is to be suspended and an imaginary plane at the free end of the ledge, which imaginary plane is represented in FIG. 2 by phantom line 34.

Another advantage of the instant invention because it does not rely on abutment against the opposite side of the object is that the support hanger provides suspension without being limited as to the width of the object. That is, since it is not necessary that an abutment engage the opposed side, the configuration of such opposed side does not present a limitation. The support hanger of the invention can be used equally effectively with objects, such as freezer doors, of differing widths and thicknesses. Most desirably when the support hanger is to be used with an object such as a freezer door that is often moved, it is placed at a location in which there will be minimal movement. Insofar as a freezer door is concerned, this means that it should be placed near the hinge end as illustrated in FIG. 3 rather than close to the handle.

Figure 4:
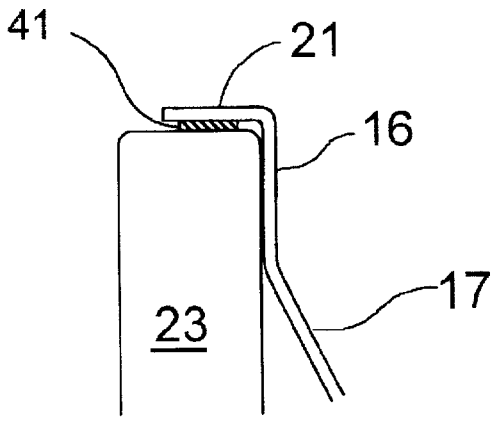
FIGS. 4–7 are partial views showing alternate arrangements for providing the resistance means of the invention.
Figure 5:
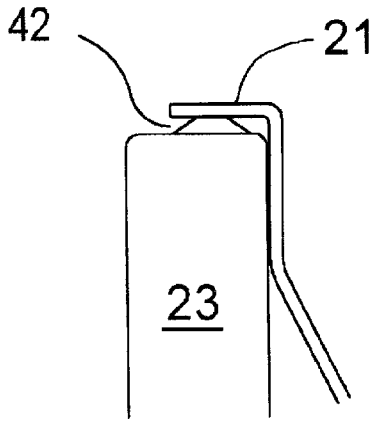
Figure 6:
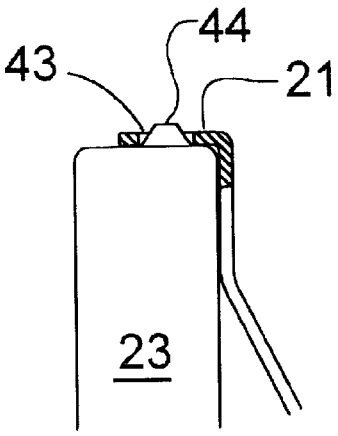
Figure 7:
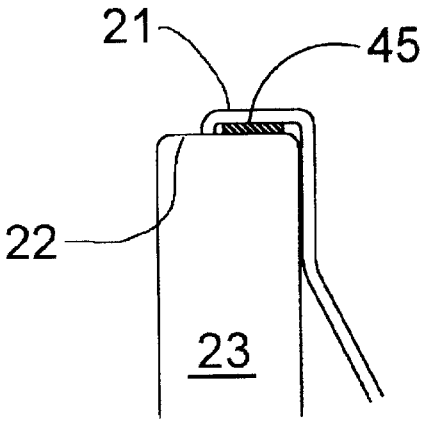

FIG. 4 shows an alternate arrangement in which a permanent magnet 41 is used as the resistance means. Such a magnet is useful, of course, only for securing the support hanger of the invention to objects having iron at or adjacent the surface to be engaged by the supporting ledge 21. FIG. 5 shows an arrangement in which a plurality (only one of which is shown) of suction cups project downward from the underneath surface of the ledge to engage the surface, and FIG. 6 shows an arrangement in which an aperture 43 is provided in the ledge to engage a projecting stop 44 adhered adhesively, for example, to the surface. (Ledge 21 is shown partially broken away in FIG. 6 to facilitate seeing the aperture and manner in which an edge of the same engages the projection.) FIG. 7 shows an arrangement in which the free end of the substantially planar ledge 21 is turned downwardly to nest a resistive strip 45 adhesively attached, for example, to surface 22. It is to be noted that even though the free end of the ledge is made somewhat re-entrant, a lip for abutment against an opposed side of the object 23 is not provided—the free edge of the ledge engages the horizontal surface 22 of the object.

Figure 8:
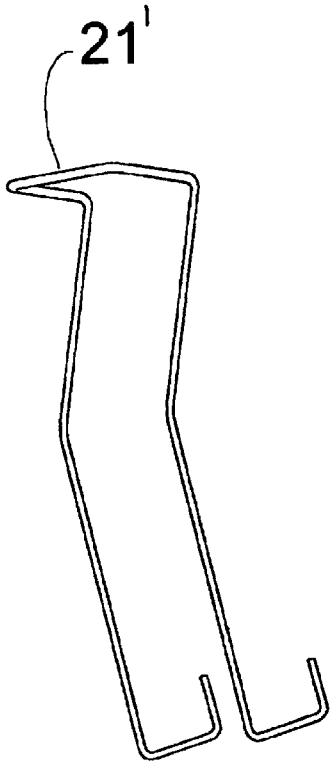
FIGS. 8 and 9 show alternate embodiments of the invention.
Figure 9:
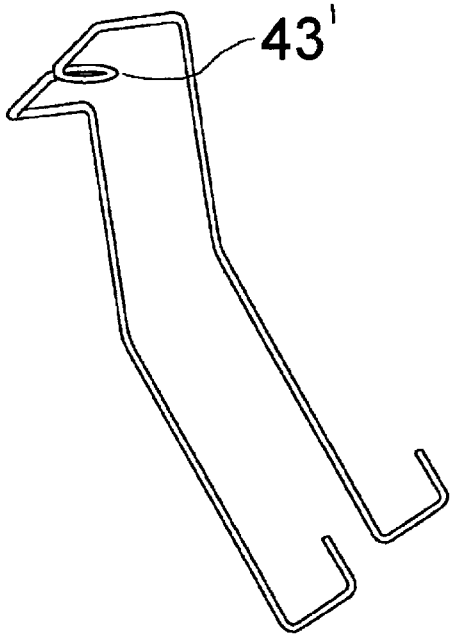

It is to be noted that making the most of the unit from a single piece of clear plastic results in an aesthetically pleasing hanger. In this connection, if desired a pattern can be provided by sketching or by hot stamping of the stock. FIGS. 8 and 9 illustrate an arrangement in which the hanger is made from a substance other than a continuous sheet of plastic stock. In such arrangement, a wire is bent to provide the various parts. As is illustrated in FIG. 8, the ends of the wire provide the lip (in this case, prongs) for holding the bottom of a suspended object whereas the midsection of the wire provides the ledge 21'. In those instances in which a projection is provided on the surface from which the support hanger is to suspend a weight, an "aperture" 43' can be provided as shown in FIG. 9 out of wire.

As mentioned at the beginning of the detailed description, applicant is not limited to the specific embodiment and variations described above. They are exemplary, rather than exhaustive. The claims, their equivalents and their equivalent language define the scope of protection.

What is claimed is:

1. A support hanger for suspending an article from an object, said object having a generally horizontal surface, said hanger supporting said article from said horizontal surface without requiring said article being suspended directly below said horizontal surface, said support hanger comprising:

A. a continuous piece of plastic sheet stock wherein said continuous piece of plastic sheet stock provides 1. a generally horizontal ledge for engaging said horizontal surface and a first section projecting vertically downwards from said horizontal ledge,
2. support means for supporting said article, said support means having a second section canted angularly from said first section depending downwardly from said horizontal ledge and said support means having a cradle for supporting said article; and
3. a configuration such that all of said support means lies outside a vertical volume below said horizontal ledge wherein said volume is defined by the projection of said horizontal ledge downward directly below said horizontal ledge; and B. resistance means on said horizontal ledge positioned to cooperate with said horizontal surface to resist any force that might result in a generally horizontal movement of said horizontal ledge relative to said horizontal surface while said article is being supported.

2. The support hanger of claim 1 for suspending an article wherein said resistance means comprises a strip of material having a plurality of hooks or loops to engage a complementary strip of material on said horizontal surface.

3. The support hanger of claim 1 wherein said article is a book.

4. A support hanger for suspending a weight from an object, said object having a generally horizontal surface, said hanger supporting said weight from said horizontal surface without requiring said weight being directly below said horizontal surface, said support hanger comprising:

a) support means for supporting said weight wherein said support means is configured to support said weight in a canted position;

b) a generally horizontal ledge for engaging said horizontal surface, said ledge being rigidly secured to said support means;

c) said support hanger being configured to provide said support means outside a vertical volume below said horizontal ledge wherein said volume is defined by the projection of said horizontal ledge downwards directly below said horizontal ledge; and d) resistance means on said horizontal ledge cooperating with said horizontal surface to resist any force that might result in a generally horizontal movement of said horizontal ledge relative to said horizontal surface while said weight is being supported.

5. A support hanger for suspending an article of print from an object, said object having a generally horizontal surface, said hanger supporting said article of print from said horizontal surface without requiring said article of print being directly below said horizontal surface, said support hanger comprising:

A. a continuous piece of plastic sheet stock, said sheet stock providing 1) support means for supporting said article of print wherein said support means is configured to support said article of print in a generally canted position,
2) a generally horizontal ledge for engaging said horizontal surface, said horizontal ledge being rigidly secured to said support means, and
3) said continuous piece of plastic stock being transparent at all locations in which during normal use of the same supporting said article of print it might block print and being configured to provide all of said support means outside a vertical volume below said horizontal ledge, said volume being defined by the projection of said horizontal ledge downwards directly below the same; and B. resistance means on said horizontal ledge positioned to cooperate with said horizontal surface to resist any force that might result in a generally horizontal movement of said horizontal ledge relative to said horizontal surface while said article of print is being supported.

* * * * *